US006202600B1

(12) United States Patent
Miceli

(10) Patent No.: US 6,202,600 B1
(45) Date of Patent: Mar. 20, 2001

(54) OSCILLATING TWO STROKE INTERNAL COMBUSTION ENGINE

(76) Inventor: Robert Miceli, P.O. Box 177, Albrightsville, PA (US) 18210

( * ) Notice: Subject to any disclaimer, the term of this patent is extended or adjusted under 35 U.S.C. 154(b) by 0 days.

(21) Appl. No.: 09/210,613

(22) Filed: Dec. 14, 1998

Related U.S. Application Data

(60) Provisional application No. 60/074,653, filed on Feb. 13, 1998.

(51) Int. Cl.[7] ..... F02B 53/00
(52) U.S. Cl. ..... 123/18 R
(58) Field of Search ..... 123/18 R; 91/177

(56) References Cited

U.S. PATENT DOCUMENTS

| | | | | |
|---|---|---|---|---|
| 1,042,322 | * | 10/1912 | Chubbuck | 123/18 R |
| 2,127,743 | * | 8/1938 | Linthwaite | 123/18 R |
| 2,203,047 | * | 6/1940 | Cushman | 123/18 R |
| 2,989,040 | * | 6/1961 | Zalisko | 123/18 R |
| 4,027,475 | * | 6/1977 | Folsom | 123/18 R |
| 4,599,976 | | 7/1986 | Meuret . | |
| 4,884,532 | | 12/1989 | Tan et al. . | |
| 5,074,253 | | 12/1991 | Dettwiler . | |
| 5,086,732 | | 2/1992 | Seno . | |
| 5,152,254 | | 10/1992 | Sakita . | |
| 5,228,414 | | 7/1993 | Crawford . | |

FOREIGN PATENT DOCUMENTS

| | | |
|---|---|---|
| 2639450 | 3/1978 | (DE) . |
| 619995 | 3/1949 | (GB) . |

* cited by examiner

*Primary Examiner*—Michael Koczo
(74) *Attorney, Agent, or Firm*—Richard C. Litman

(57) ABSTRACT

A two-stroke internal combustion engine includes an oscillating member, two stator walls, two engine casing members, two engine casing end plates, and at least two generating assemblies, magnetically coupled to the oscillating internal combustion engine and converting mechanical energy into electrical energy. The two engine casing members are attached, with the two stator walls sandwiched in between, to form a cylinder bisected by the walls. Two engine casing end plates, having bearing surfaces adapted to allow the ends of the shaft of the oscillating member to pass therethrough, close the top and bottom of the cylindrical engine casing. The oscillating member has a hollow shaft with two outwardly extending opposing vanes. The oscillating member shaft is disposed within the cylindrical engine casing between the stator walls. The vanes rotate reciprocally between the two coplanar stator walls following a two-stroke cycle. The hollow shaft of the oscillating member has openings between the outwardly extending vanes acting as air intake ports. Air is forced through the hollow shaft and into the combustion chambers during periods when the ports are not closed off by the stator walls. Exhaust ports are located in the engine casing members which vent exhaust from the combustion areas depending on the position of the rotor. A generator or a mechanical ratchet is used to convert the oscillating motion of the engine into rotational motion.

3 Claims, 9 Drawing Sheets

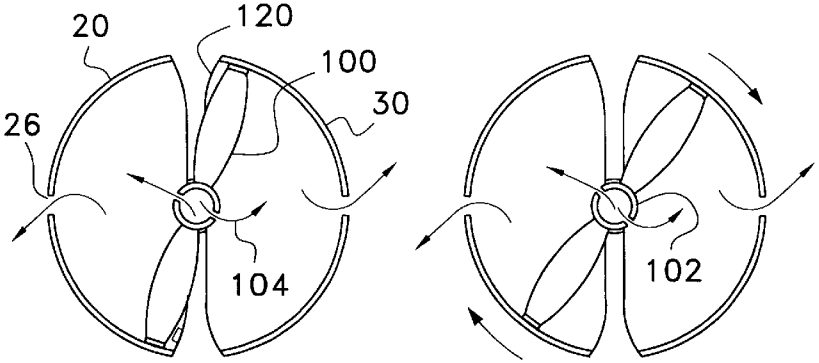
Fig. 9A
Fig. 9B
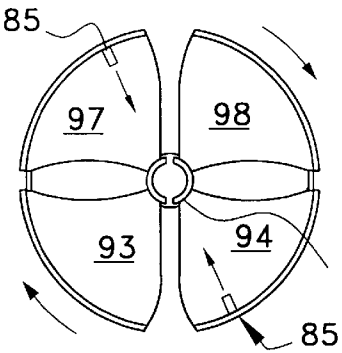
Fig. 9C
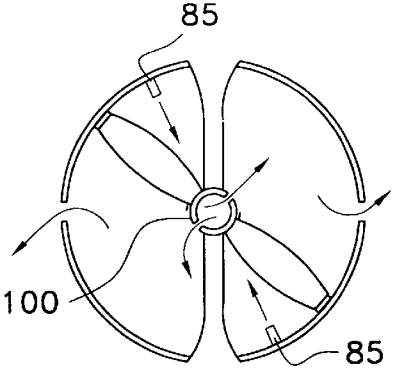
Fig. 9D
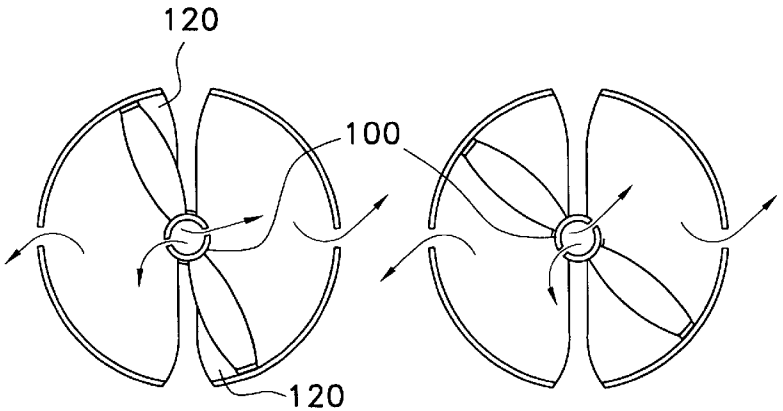
Fig. 9E
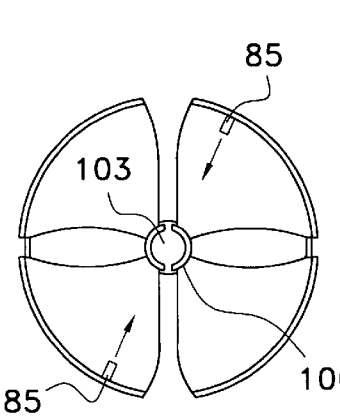
Fig. 9F
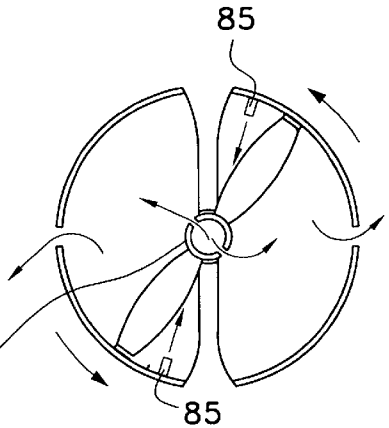
Fig. 9G
Fig. 9H

OSCILLATING TWO STROKE INTERNAL COMBUSTION ENGINE

CROSS-REFERENCE TO RELATED APPLICATION

This application claims the benefit of U.S. Provisional Patent Application Serial No. 60/074,653, filed Feb. 13, 1998.

BACKGROUND OF THE INVENTION

1. Field of the Invention

The present invention relates to engines and, more specifically, to an oscillating two-stroke internal combustion engine having a shaft with two opposing vanes as the oscillating member.

2. Description of Related Art

As an alternative to conventional internal combustion piston engines, oscillating internal combustion engines have been proposed. Such devices are well known in the art as evidenced by the U.S. Patents to Folsom, U.S. Pat. No. 4,027,475; Tan et al., U.S. Pat. No. 4,884,532; Meuret, U.S. Pat. No. 4,599,976; Dettwiler, U.S. Pat. No. 5,074,253; Sakita, U.S. Pat. No. 5,152,254; Crawford, U.S. Pat. No. 5,228,414; Seno, U.S. Pat. No. 5,086,732; and Meuret, U.S. Pat. No. 4,599,976. Also of interest is the British Patent, Number 619,995 to Triani and the German Patent, Number 2,639,450, to Theilen. The patents to Tan et al., discloses a swinging-piston engine having a crank and connecting rod mechanism in which the piston swings around a fixed shaft and sweeps the combustion cylinders. The Dettwiler patent discloses an internal combustion engine having a rotor mounted in a circular casing, a pair of radial partitions fixed in the casing to define two chambers, and pistons radially fixed to the rotor such that the pistons oscillate in their chambers. The patent to Sakita describes an internal combustion engine having a pair of pistons connected to an oscillating shaft and means for converting the oscillating motion of the shaft to rotary motion. The patent to Crawford discloses a valveless two-stroke engine having a fan-shaped combustion chamber, wherein the moving element is not a piston, but is a pivoted divider oscillating within the combustion chamber. The German patent to Theilen discloses an oscillating piston-type engine having diametrically opposite pistons connected to a hub and camshafts for actuating inlet and outlet valves in succession. The Meuret patent describes a rotary piston engine having a dual piston shaped as a semicircular vane mounted about a rotating shaft going through the center of a spherical chamber, and including external means for converting the reciprocating rotation of the piston into a continuous rotation. The patent to Seno discloses a four stroke concentric oscillating rotary vane engine including a stator, a rotor, four arcuate combustion chambers, a pair of forced porting mechanisms for controlling the forced porting of air into the combustion chamber, and a pair of cranking mechanisms for controlling the oscillating rotary motion of the rotor. The Folsom patent describes a drive system using an oscillating rotor engine of the internal combustion type in which the output of the oscillating shaft is converted directly into usable energy without the necessity of a crank converter. The British patent to Triani discloses a two-stroke internal combustion engine in which combustion gases act on at least two pairs of vanes that can oscillate within a cylinder coaxial with the main shaft and revolve in opposite directions to each other, such as to impart a continuous rotary motion to the main shaft by means of clutches.

However, none of the prior art devices includes an oscillating element having a hollow shaft with air intake ports disposed between the outwardly extending vanes through which air is forced into the combustion chamber for mixing with fuel and expelling exhaust therefrom during periods when the ports are not closed of by the stator walls. Nor do any of the prior art devices propose the use of a magnetic coupling or a ratchet to convert the oscillating motion of the engine into rotational motion. Nor do any of the prior art devices propose affixing permanent magnets to the output shaft of the engine and surrounding them with wire coils wherein the oscillating mechanical motion of the permanent magnet induces an alternating current in the coils as a means to convert the oscillating motion of the engine into a useable form of energy.

None of the above inventions and patents, taken either singly or in combination, is seen to describe the instant invention as claimed.

SUMMARY OF THE INVENTION

The two-stroke internal combustion engine of the instant invention includes an oscillating member two stator walls, two engine casing members, two engine casing end plates, and at least one generating means. The generating means is magnetically coupled to the oscillating internal combustion engine and converts the mechanical energy into electrical energy. The two engine casing members are attached, with the two stator walls sandwiched in between to form a cylinder which is substantially bisected by the walls. Two engine casing end plates, having bearing surfaces adapted to allow the ends of the shaft of the oscillating member to pass therethrough, close the top and bottom of the cylindrical engine casing.

The oscillating member has a hollow shaft with two outwardly extending opposing vanes attached thereto. The shaft of the oscillating member is disposed within the cylindrical engine casing between the stator walls forming four distinct combustion areas. The vanes rotate reciprocally between the two coplanar stator walls following a two-stroke cycle with simultaneous opposing combustion. The hollow shaft of the oscillating member has openings disposed between the outwardly extending vanes which act as air intake ports. Air is forced through the hollow shaft and into the combustion chambers during periods when the ports are not closed off by the stator wall. Exhaust ports are located in the engine casing members which vent exhaust from the four distinct combustion areas depending on the orientation of the two opposing vanes. An electromagnetic coupling or clutch system or a bidirectional ratchet is used to convert the oscillating motion of the engine into rotational motion. Alternatively, a generating means is coupled to the exposed ends of the shaft of the oscillating member which converts the oscillating movement of the oscillating member into electric energy.

Accordingly, it is a principal object of the invention to provide an oscillating two-stroke internal combustion engine having an oscillating member with a hollow shaft and openings which act as air intake ports disposed between outwardly extending vanes.

It is another object of the invention to provide a mechanical ratchet to convert the oscillating motion of the engine into rotational motion.

It is a further object of the invention to provide a generating means that is coupled to the exposed ends of the shaft of the oscillating member to convert the oscillating movement of the oscillating member into electric energy.

Still another object of the invention is to provide an engine having a electromagnetic coupling at each end of the hollow shaft according to the invention for converting the oscillating motion of the engine into rotational motion.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 9A is a diagrammatical view of an oscillating two stroke internal combustion engine at the maximum counterclockwise position, just prior to ignition.

FIG. 9B is a diagrammatical view of an oscillating two stroke internal combustion engine, post ignition, moving in the clockwise direction.

FIG. 9C is a diagrammatical view of an oscillating two stroke internal combustion engine moving in a clockwise direction at the point when the oscillating member closes off the exhaust ports.

FIG. 9D is a diagrammatical view of an oscillating two stroke internal combustion engine moving in the clockwise direction wherein exhaust of the clockwise power stroke is being expelled from the exhaust port and fuel continues to be added to the fuel air mixture as it undergoes compression.

FIG. 9E is a diagrammatical view of an oscillating two stroke internal combustion engine at the maximum clockwise position just prior to ignition.

FIG. 9F is a diagrammatical view of an oscillating two stroke internal combustion engine, post ignition, moving in the counterclockwise direction.

FIG. 9G is a diagrammatical view of an oscillating two stroke internal combustion engine moving in a counterclockwise direction at the point when the oscillating member closes off the exhaust ports.

FIG. 9H is a diagrammatical view of an oscillating two stroke internal combustion engine moving in the counterclockwise direction wherein exhaust of the counterclockwise power stroke is being expelled from the exhaust port and fuel continues to be added to the fuel air mixture as it undergoes compression in the opposing chambers.

Similar reference characters denote corresponding features consistently throughout the attached drawings.

DETAILED DESCRIPTION OF THE PREFERRED EMBODIMENT

Figure 1:
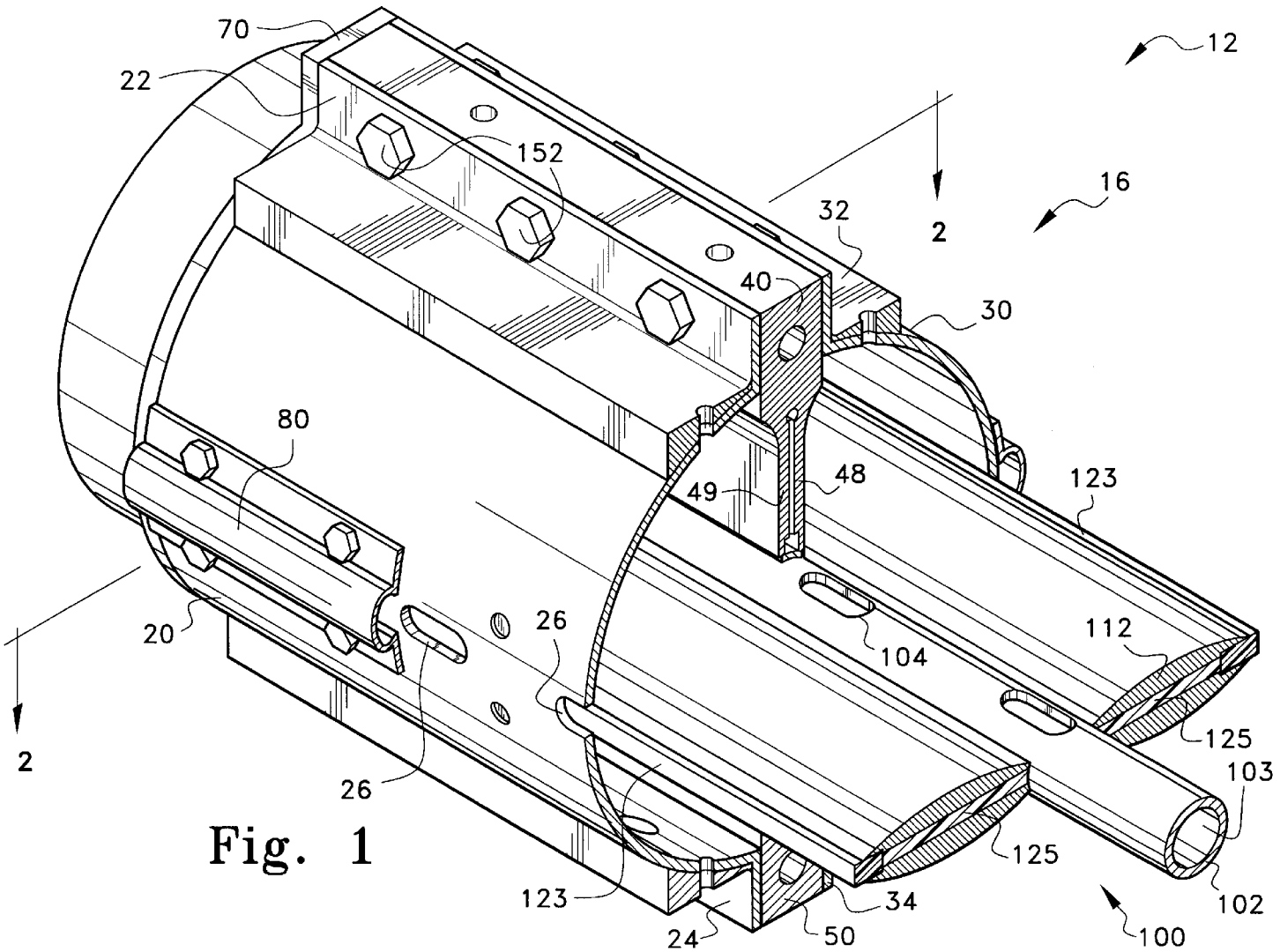
FIG. 1 is a perspective view of an oscillating two stroke internal combustion engine according to the present invention having a portion of the engine casing and stator wall removed to expose the oscillating member.

Referring to the figures by numerals of reference, an oscillating two-stroke internal combustion engine generally designated by the reference numeral 12 will be described.

Figure 2:
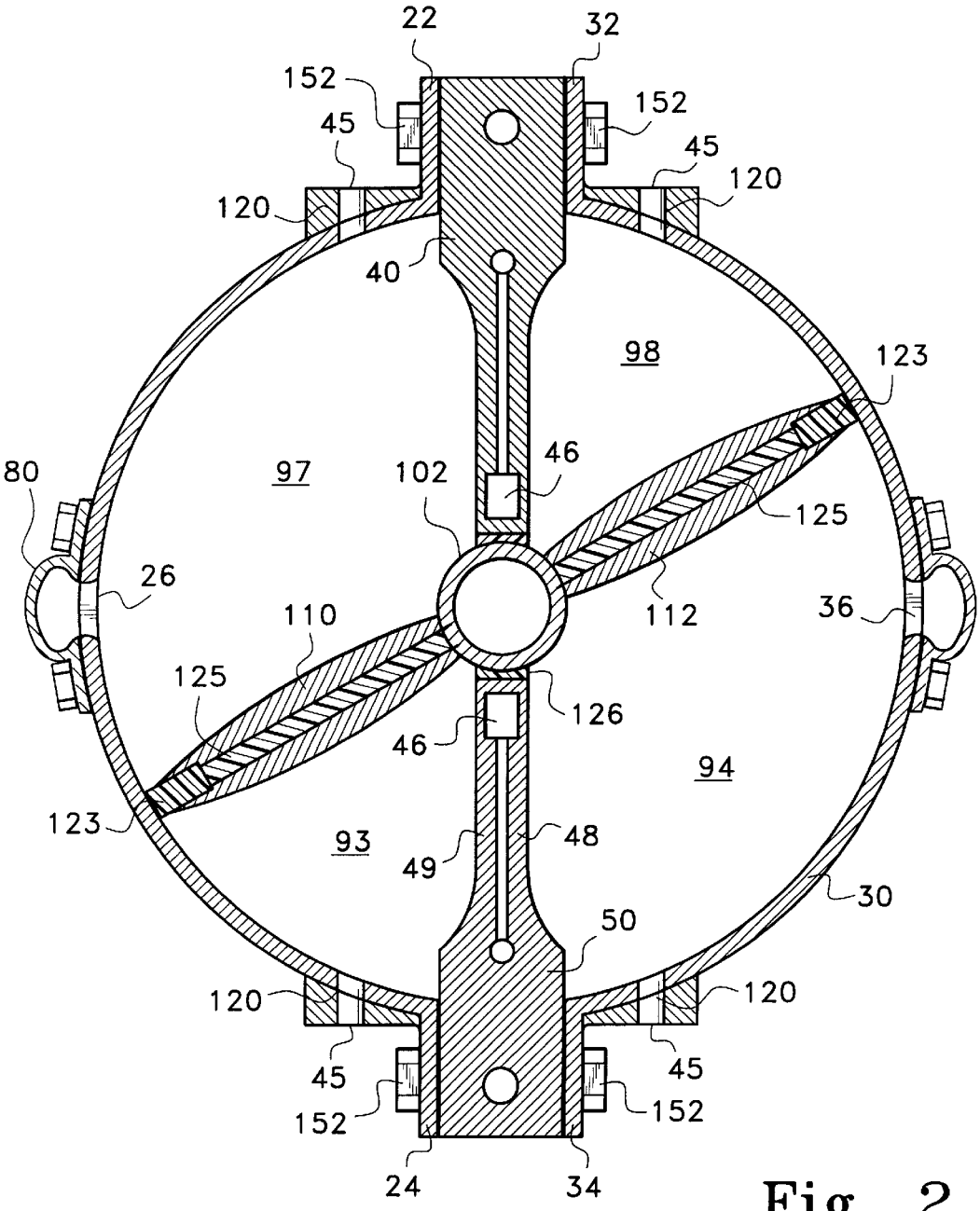
FIG. 2 is a cross-sectional view of the oscillating two stroke internal combustion engine taken along line 2—2 in FIG. 1.

Referring to FIGS. 1 and 2, the oscillating two stroke internal combustion engine includes a cylindrical engine casing 16 formed by joining together a first half-cylinder casing member 20, a second half-cylinder casing member 30, a substantially solid wedge-shaped first stator wall 40, a substantially solid wedge-shaped second stator wall 50, a first engine casing end plate 60 (shown in FIGS. 3 and 4), and a second engine casing end plate 70.

The first half-cylinder casing member 20 has a first flange 22, a second flange 24 and a plurality of exhaust ports 26 at the apex of the first half-cylinder casing member. The second half-cylinder casing member 30 has a first flange 32, a second flange 34 and a plurality of exhaust ports 36 at the apex of the second half-cylinder casing member. The first stator wall 40 is attached by bolts 152 between the first flange 22 of the first half-cylinder casing member 20 and the first flange 32 of the second half-cylinder casing member 30 with metal reinforcement machined thereabout. The second stator wall 50 is attached by bolts 152 between the second flange 24 of the first half-cylinder casing member 20 and the second flange 34 of the second half-cylinder casing member 30 with metal reinforcement thereabout.

The first engine casing end plate 60 is attached to one end of the cylindrical engine casing 16 and the second engine casing end plate 70 is attached to the other end of the cylindrical engine casing 16. Both of the engine casing end plates 69, 70 include threaded channels shown as passages 44 in FIG. 8 for oil passage to the respective stators (not shown). Exhaust manifolds 80 are attached to the exterior of each of the half-cylinder engine casing members 20, 30.

Figure 7:
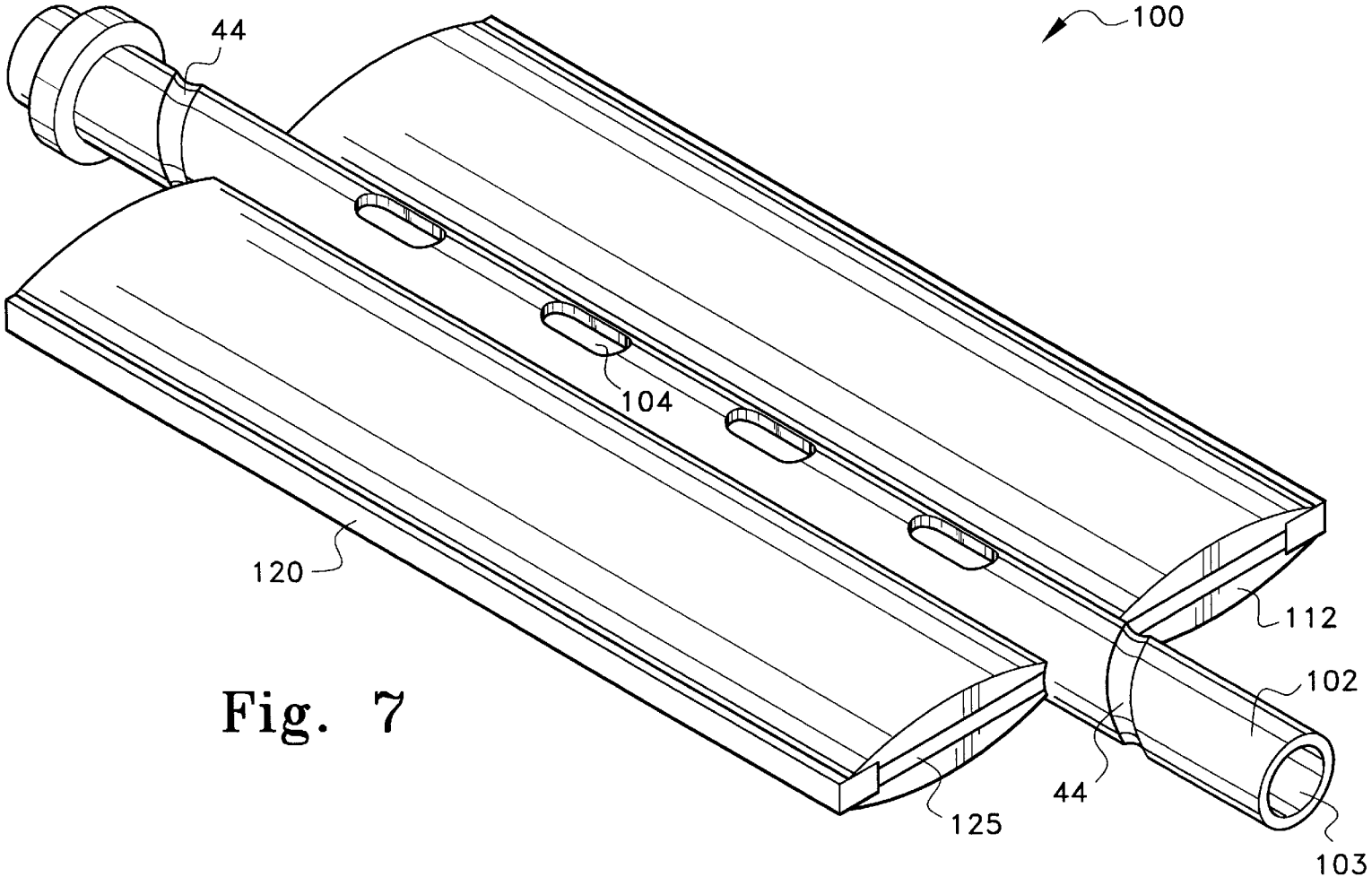
FIG. 7 is a perspective view of an oscillating member for an oscillating two stroke internal combustion engine, illustrating the collars for thrust bearings and grooves for oil passage.

Referring to FIGS. 2 and 7, an oscillating member 100 is positioned between the two stator walls 40, 50 to define four distinct combustion areas; upper clockwise chamber 98, upper counterclockwise chamber 97, lower clockwise chamber 94, and lower counterclockwise chamber 93. The oscillating member 100 has a hollow shaft 102 with two opposing vanes 110, 112 outwardly extending therefrom. A plurality of elongated sealing members 123 and 125 effect a seal between the opposing vanes 110, 112 of the reciprocating member 100 and the first half-cylinder casing member 20, the second half-cylinder casing member 30, the first engine casing end plate 60, and the second engine casing end plate 70 respectively. Sealing members 121 effect a seal between the stator walls 40,50 and the shaft 102 of the oscillating member 100. A plurality of ports 104 pass from the interior of the hollow shaft 102 to the exterior thereof (see FIG. 1), between the opposing vanes 110, 112.

While the ports 104 are shown in FIGS. 1 and 7 as an exemplary embodiment, the ports 104 according to the invention are preferably circular ports. Circular ports have the advantage of being easy to machine or provide within the shaft as compared to the exemplary embodiment. The openings 104 act as air intake ports. Air is forced through the hollow shaft 102 by a supercharger (not shown) and into the combustion chambers 93, 94, 97, 98 during periods when the ports 104 are not closed off by the stator walls 40, 50. A plurality of spark plugs can be disposed within the stator walls or within the housing as desired to provide the catalyst for combustion.

While the particular arrangement of the spark plugs has not been shown, it would be obvious to one of ordinary skill in the art to arrange the spark plugs disposed within the oscillating engine stator walls or other arrangement as a mere matter of obvious design choice. Since the spark plugs are necessary for combustion, the placement of the spark plugs is considered to be determined as a matter of intended use of said plugs by the skilled artisan. An exemplary arrangement can be sealed segments 120 which are machined to accommodate spark plugs along the flat surface 45 of the cylinder casing wherein fuel injectors are also disposed along this surface (not shown).

Figure 3:
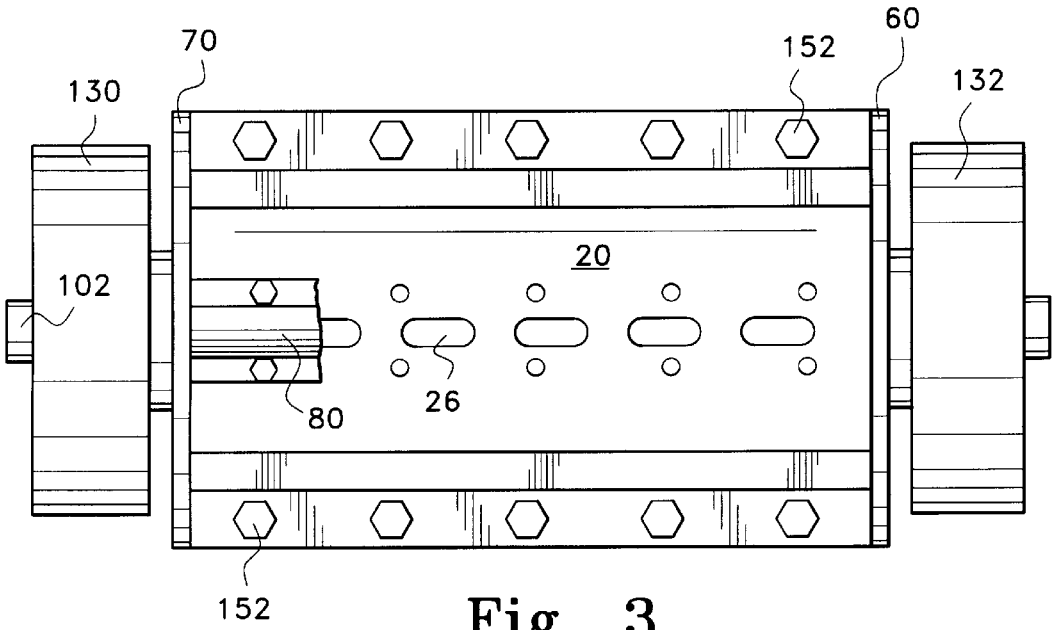
FIG. 3 is a side elevation view of the oscillating two stroke internal combustion engine with generators.
Figure 4:
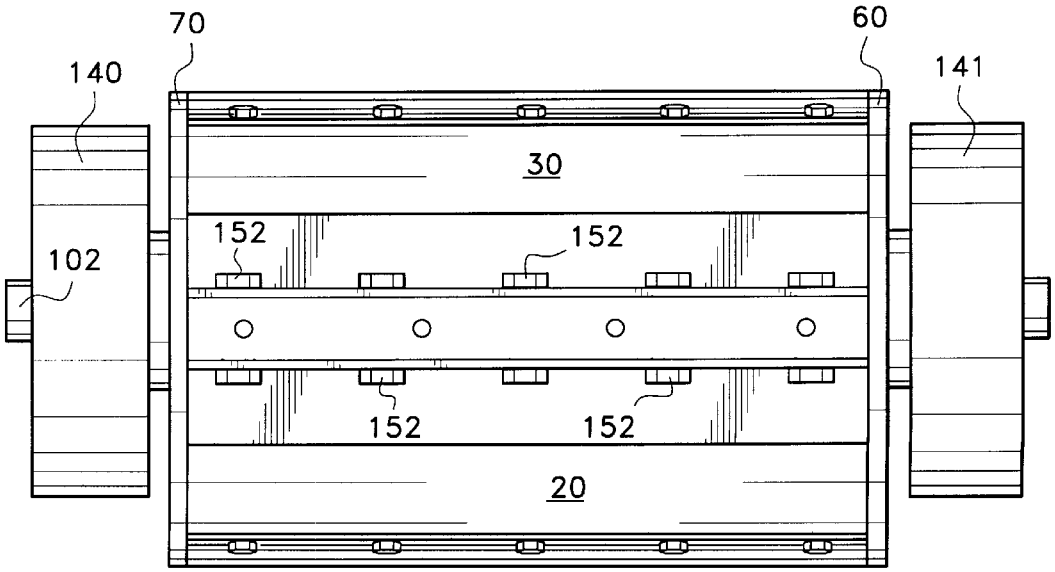
FIG. 4 is a top plan view of the oscillating two stroke internal combustion engine with a bidirectional ratchet convertor.

Referring to FIG. 3 and 4, a pair of converters or the two portions of a single converter are attached to the exposed ends of the shaft 102 of the oscillating member 100. Referring now to FIG. 3, the pair of converters may be generators 130, 132 having permanent magnets (not shown) affixed to the ends of the shaft 102 or magnetized one piece iron or steel rotor and wire coils (not shown) surrounding the ends of the shaft such that the oscillating movement of the permanent magnets and their corresponding magnetic fields induce a flow of electrons in the wire coils.

Referring now to FIG. 4, alternatively, the converter is a mechanical ratchet which uses a clockwise ratchet 140 at one end of the shaft 102 and a counterclockwise ratchet 141 at the other end of the shaft 102.

Figure 5:
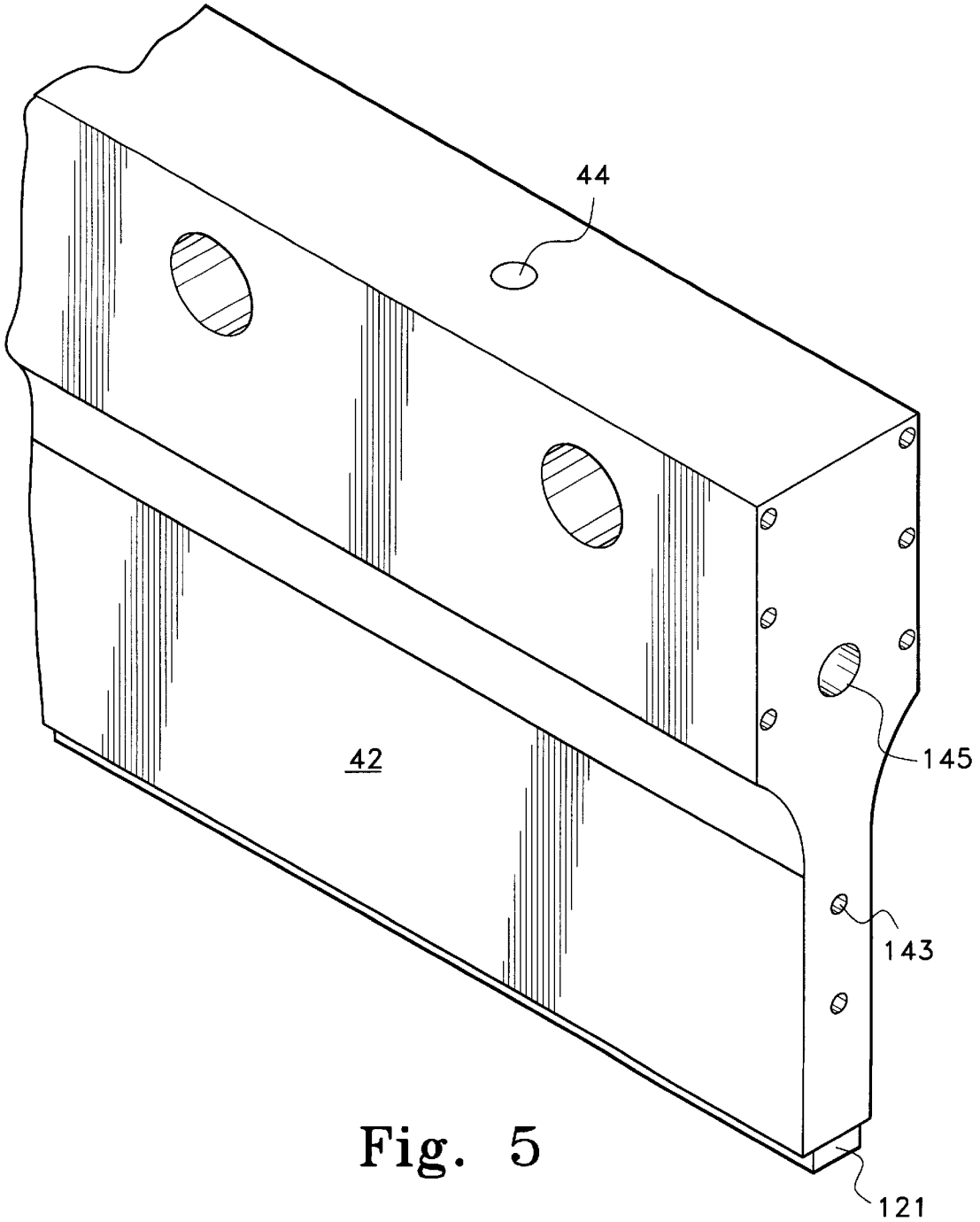
FIG. 5 is a perspective view of a stator wall for an oscillating two stroke internal combustion engine.

Referring to FIG. 5, the stator walls 40 and 50 of the oscillating two stroke internal combustion engine each include a plurality of oil passages 44 passing through the vertical lower wall 42 of the first wedge-shaped stator wall 40 and the second wedge-shaped stator wall 50. As best shown in FIGS. 1 and 2 vertically disposed oil containment channel 46 is affixed between the solid wall 48 and 49 of each of the respective wedge-shaped stator walls 40 and 50 directly below the plurality of oil passages 44 which together enable lubrication of the shaft 102 of the oscillating member and the gradual introduction of lubricating oil into the combustion chambers 93, 94, 97, 98 through the air intake ports 104. A plurality of arcuate bearings (not shown) are disposed between the stator walls 40, 50 and the shaft 102 of the oscillating member 100 which have a structure and which receive lubrication from the oil passages 44 in a manner substantially like the bearings used to support a crankshaft within a conventional internal combustion piston engine.

Figure 6:
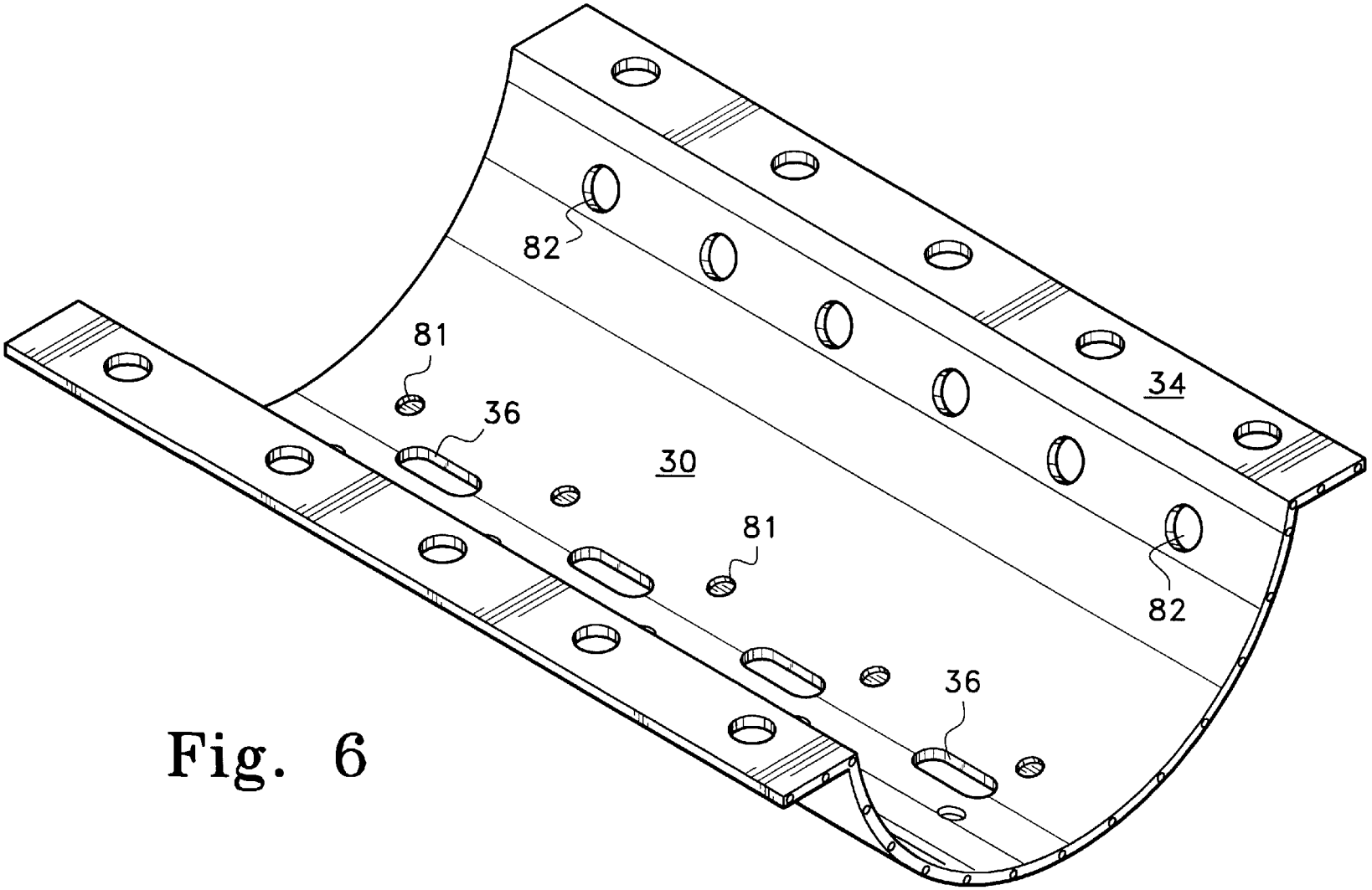
FIG. 6 is a perspective view of an engine casing member for an oscillating two stroke internal combustion engine.

Referring to FIG. 6, a plurality of threaded holes 82 for receiving a plurality of fuel injectors 85 (see FIGS. 9C–9D and 9G–9H) are linearly disposed between the flanges and the exhaust ports of both half-cylinder engine casing members 20 and 30. A plurality of threaded holes 81 have also been included to secure the respective manifolds 80 onto both half-cylinder engine casing members 20 and 30.

Figure 8:
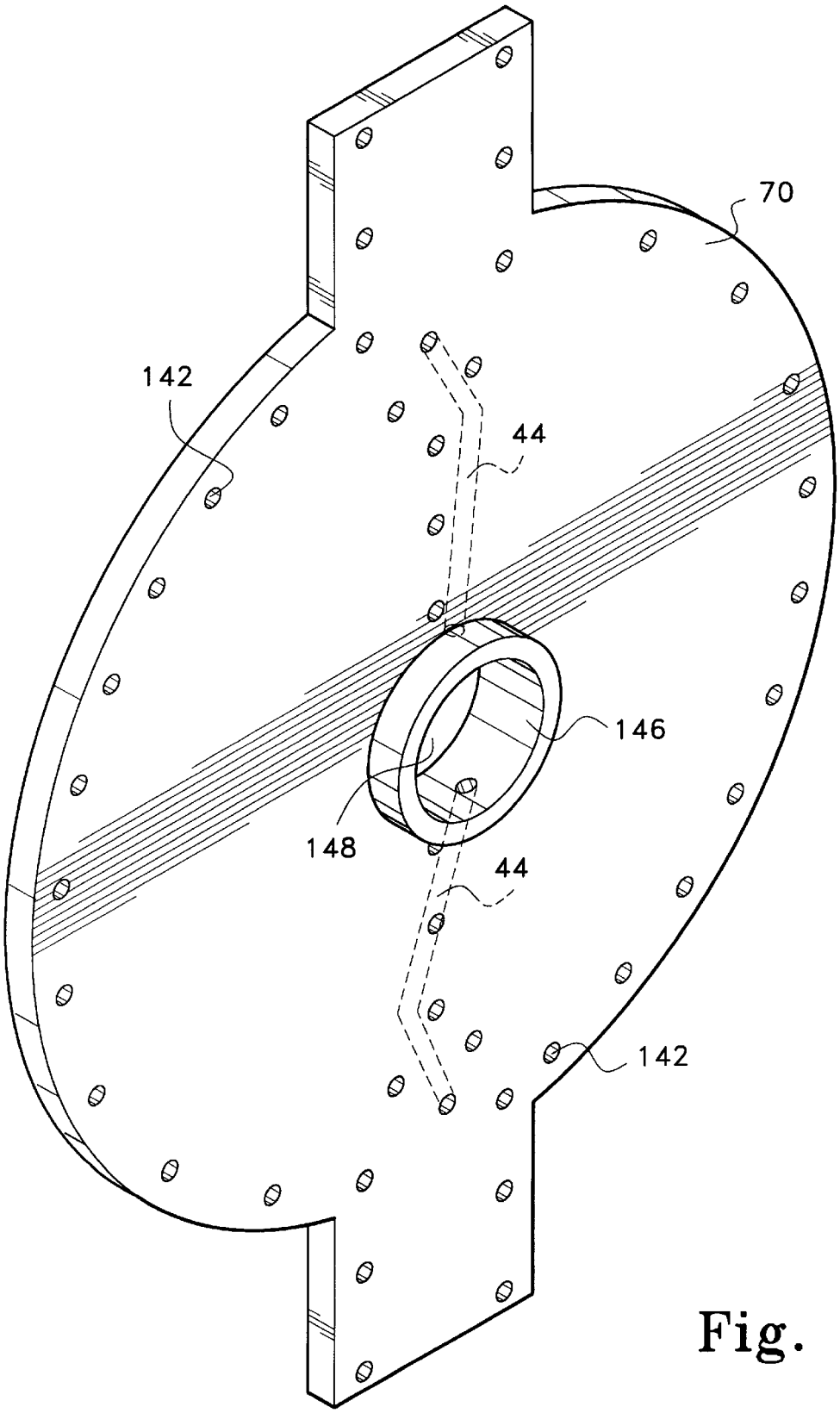
FIG. 8 is a perspective view of an engine casing end plate for an oscillating two stroke internal combustion engine, illustrating oil passages for the stator therein.

Referring to FIGS. 5 and 8, each engine casing end plate 60, 70 for an oscillating two stroke internal combustion engine 12 has a plurality of holes 142 through which pass a plurality of bolts 152 which secure the plates 60, 70 to the first half-cylinder casing member 20, the second half-cylinder casing member 30, the wedge-shaped first stator wall 40, and the wedge-shaped second stator wall 50. Each plate 60, 70 also includes an aperture 148, 158 having bearing surfaces 146 adapted to allow the ends of the shaft 102 of the oscillating member 100 to pass there through and maintain an effective seal. Oil passages 143 and coolant passage 145 are constructed to deliver lubricants and coolant to the respective stator walls.

Referring to FIG. 9A, the oscillating member 100 is at the maximum counterclockwise position just prior to ignition or firing of the spark plugs (not shown). Air is being forced into the interior 103 of the hollow shaft of the oscillating member 100 and clearing exhaust from the two previously fired counterclockwise combustion chambers 93, 97.

Referring to FIG. 9B, the oscillating member 100 is moving in the clockwise direction, post ignition, while air continues to be forced into the two previously fired counterclockwise combustion chambers 93, 97.

Referring to FIG. 9C, the oscillating member 100 is moving in a clockwise direction at the point when the oscillating member passes the exhaust ports 26 and fuel begins to be injected by the injectors 85 into the two counterclockwise combustion chambers 93, 97 in preparation for fuel-air compression.

Referring to FIG. 9D, the oscillating member 100 continues moving in the clockwise direction while exhaust from the clockwise power stroke, chambers 94, 98, is being expelled from the exhaust ports 26 and fuel continues to be added to the fuel-air mixture as it undergoes compression.

Referring to FIG. 9E, the oscillating member 100 is at the maximum clockwise position just prior to ignition or firing of the spark plugs (not shown). Air is being forced into the interior 103 of the hollow shaft of the oscillating member 100 and clearing exhaust from the two previously fired clockwise combustion chambers 94, 98.

Referring to FIG. 9F, the oscillating member 100 is moving in the counterclockwise direction, post ignition, while air continues to be forced into the two previously fired clockwise combustion chambers 94, 98.

Referring to FIG. 9G, the oscillating member 100 is moving in a counterclockwise direction at the point when the oscillating member 100 passes the exhaust ports 26 and fuel begins to be injected by the injectors 85 into the two clockwise combustion chambers 94, 98 in preparation for fuel-air compression.

Referring to FIG. 9H, the oscillating member 100 continues moving in the counterclockwise direction while exhaust from the counterclockwise power stroke, chambers 93, 97,is being expelled from the exhaust ports 26 and fuel continues to be added to the fuel-air mixture as it undergoes compression.

Figure 10:
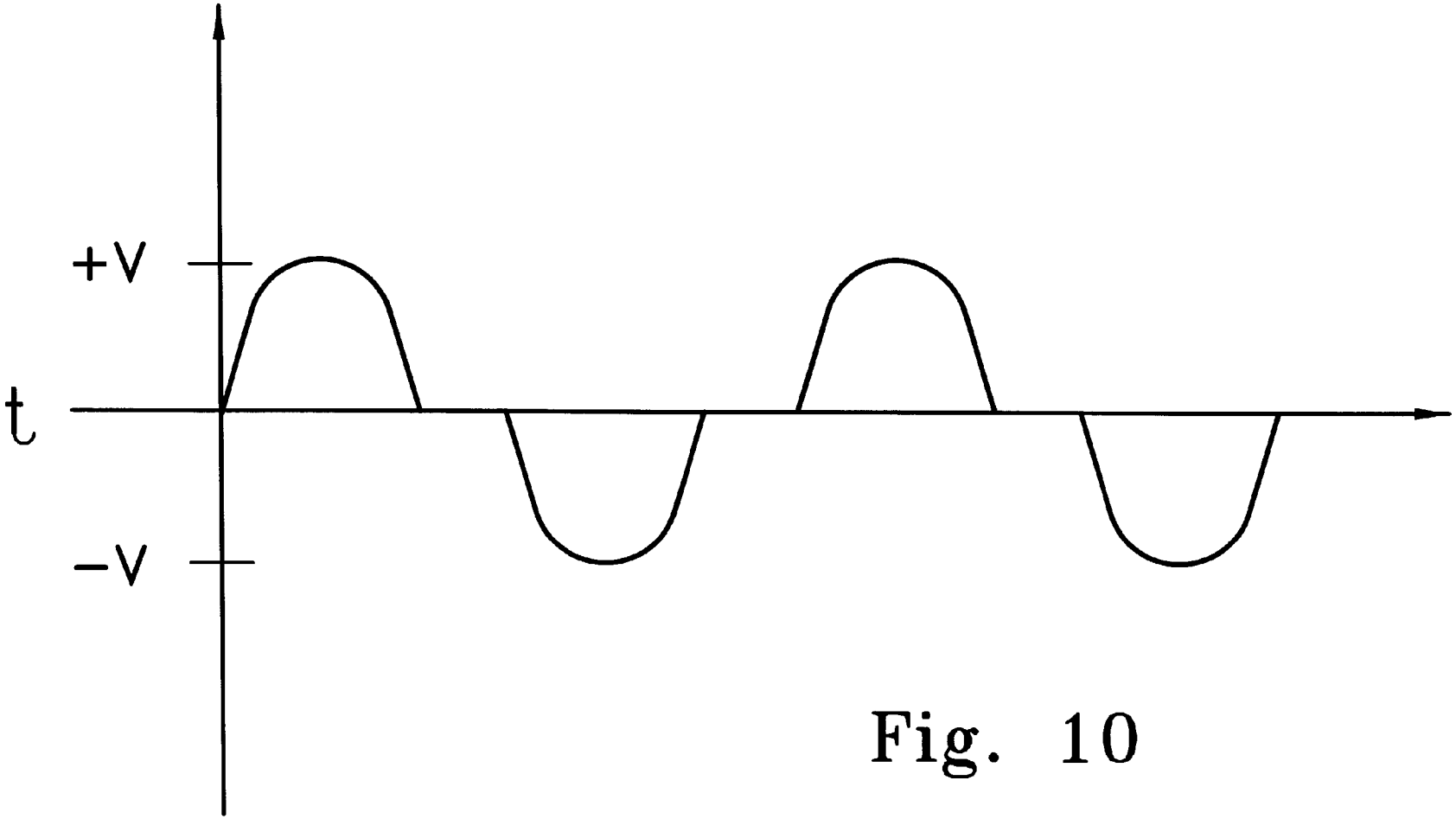
FIG. 10 is a time domain representation of the output of a generator magnetically coupled to the oscillating two stroke internal combustion engine according to the present invention.

FIG. 10 shows a time domain representation of the output of a generator 130 attached around the end of the shaft 102 of the oscillating two stroke internal combustion engine 12.

It is intended that a microprocessor (not shown) will be used to control ignition and fuel delivery systems of the oscillating two stroke internal combustion engine, and the operation phasing of electromagnetic coupling systems simultaneously. The integration of these particular features are simply herein described as a black box. Other features of the instant invention includes the use of forged steel or single crystalline titanium for the manufacturing of the engine rotor according to the instant invention. These materials have the distinct property of withstanding torsional stresses due to high velocity or super charged combustion engines.

It is to be understood that the present invention is not limited to the sole embodiment described above, but encompasses any and all embodiments within the scope of the following claims.

I claim:

1. An oscillating two stroke internal combustion engine comprising:

a cylindrical engine casing formed by joining together a first half-cylinder casing member, a second half-cylinder casing member, a substantially wedge-shaped first stator wall, a substantially wedge-shaped second stator wall, a first engine casing end plate, and a second engine casing end plate;

an oscillating member having a hollow shaft and two opposing vanes outwardly extending therefrom, and a plurality of holes passing from the interior of said hollow shaft to the exterior thereof, between said opposing vanes;

a plurality of oil passages passing through said first wedge-shaped stator wall and said second wedge-shaped stator wall, wherein said passages together enable lubrication of said shaft; and converting means for converting the oscillating mechanical motion of said oscillating two stroke internal combustion engine to another form of motion; and wherein, said first half-cylinder casing member has a first flange, a second flange and a plurality of exhaust ports at the apex of said first half-cylinder casing member;

said second half-cylinder casing member has a first flange, a second flange and a plurality of exhaust ports at the apex of said second half-cylinder casing member;

said first stator wall is attached between said first flange of said first half-cylinder casing member and said first flange of said second half-cylinder casing member;

said second stator wall is attached between said second flange of said first half-cylinder casing member and said second flange of said second half-cylinder casing member;

said first engine casing end plate is attached to one end of said cylindrical engine casing;

said second engine casing end plate is attached to the other end of said cylindrical engine casing; and said oscillating member is positioned between said two stator walls to define four distinct combustion areas;

said plurality of holes in said hollow shaft of said oscillating member acting as air intake ports into said combustion areas when not blocked by said stator walls.

2. The oscillating two stroke internal combustion engine according to claim 1, further comprising a plurality of arcuate bearings disposed between said stator walls and said shaft of said oscillating member.

3. The oscillating two stroke internal combustion engine according to claim 1, including a plurality of elongate sealing members which effect a seal between said opposing vanes of said reciprocating member and said first half-cylinder casing member, said second half-cylinder casing member, said first engine casing end plate, and said second engine casing end plate.

* * * * *